US006393645B1

(12) United States Patent
Kadinger

(10) Patent No.: US 6,393,645 B1
(45) Date of Patent: May 28, 2002

(54) ADJUSTABLE FITTING AND PIPE CLEANING BRUSH DEVICE

(76) Inventor: Corey D. Kadinger, N 3715 420th St., Menomonie, WI (US) 54751

( * ) Notice: Subject to any disclaimer, the term of this patent is extended or adjusted under 35 U.S.C. 154(b) by 12 days.

(21) Appl. No.: 09/680,539

(22) Filed: Oct. 6, 2000

(51) Int. Cl.[7] ..... B08B 9/02; A46B 13/02

(52) U.S. Cl. ..... 15/104.04; 15/104.05; 15/88

(58) Field of Search ..... 15/88, 104.03, 15/104.04, 104.05, 106

(56) References Cited

U.S. PATENT DOCUMENTS

| | | | |
|---|---|---|---|
| 2,303,824 A | * | 12/1942 | Comins |
| 4,301,567 A | * | 11/1981 | Tucker |
| 4,372,003 A | | 2/1983 | Toelke |
| 4,433,448 A | | 2/1984 | True |
| 4,530,127 A | | 7/1985 | Roberts |
| 4,575,892 A | | 3/1986 | Ross |
| 4,600,444 A | | 7/1986 | Miner |
| 4,862,549 A | | 9/1989 | Criswell et al. |
| 5,157,802 A | | 10/1992 | Guidry et al. |
| 5,307,534 A | | 5/1994 | Miller |
| 5,493,748 A | | 2/1996 | Santo |
| 6,065,173 A | | 5/2000 | White |
| 6,106,370 A | | 8/2000 | Carter |

OTHER PUBLICATIONS www.brenelle.com Website. pp. 1 and 2 entitled "Power Brush".

* cited by examiner

*Primary Examiner*—Randall E. Chin

(74) *Attorney, Agent, or Firm*—Tipton L. Randall

(57) ABSTRACT

The invention outlined in the disclosure is an adjustable wire brush tool for cleaning either the inside or the outside end of a copper pipe or fitting in preparation for soldering the parts together. The tool includes a hollow cylindrical section with a first wire brush on the interior surface of the section. Attached at one end of the cylindrical section is a slightly smaller cylindrical section sized to hold a second cylindrical twisted steel brush having a hexagonal shaft that extends from the smaller section, opposite the larger cylindrical section. The twisted steel brush and attached shaft can be moved to extend the twisted brush beyond the open end of the larger cylindrical section, for insertion into a fitting to clean the fitting interior surface by attaching a power drill to the shaft and rotating the twisted steel brush attached thereto. To clean the outside of a pipe, the twist brush is retracted into the smaller section and secured to that section with an engaging means. The pipe is inserted into the larger section, and the drill is activated to rotate the shaft and attached larger section to clean the pipe outer surface. The tool overcomes the need for separate tools to perform each task and requires but one drill to perform either task as needed. The tool is sized to handle a particular diameter of pipe and fitting, with sizes ranging from one quarter inch to several inches.

19 Claims, 10 Drawing Sheets

ADJUSTABLE FITTING AND PIPE CLEANING BRUSH DEVICE

CROSS-REFERENCE TO RELATED APPLICATIONS, IF ANY

Not applicable

STATEMENT REGARDING FEDERALLY SPONSORED RESEARCH OR DEVELOPMENT

Not applicable.

REFERENCE TO A MICROFICHE APPENDIX, IF ANY

Not applicable.

BACKGROUND OF THE INVENTION

1. Field of the Invention

The present invention relates to a device for cleaning pipe or tubing and fittings for soldering or brazing. More particularly, it relates to an adjustable device for abrading copper or brass tubing and fittings, using wire brushes, to remove oxides and contaminants preparatory to soldering or brazing.

2. Background Information

Soldering or brazing of pipe or tubing requires that the joined surfaces of the pipe and fittings be thoroughly cleaned of organic and inorganic contaminants before be wetted by the molten solder or brazing alloy. This cleaning is mandatory to form sound joints which are free of porosity and voids and which do not leak.

Organic contaminants, such as grease or oil, are removed by wiping the item with a solvent appropriate for removal of the organic contaminants. Inorganic contaminants, such as oxides or scale, are physically removed by rubbing the item with dry steel wool, emery cloth or wire brushes. Motor driven brushes or emery cloth are also commonly used.

Proper cleaning of joint members prior to soldering or brazing is essential in order to economically form sound joints. Clean joint surfaces can be rapidly soldered or brazed using a minimum of heat, flux, and filler alloy. These economies of time, energy, and materials more than offset the cost of proper cleaning.

Manual cleaning of a large number of tube/fitting joint components can become tedious and time consuming and can, thus, lead to operator inattention and error. Motor driven physical abrasion means clearly can eliminate tedium and permit rapid and effective cleaning of large numbers of joint components.

A number of patents have issued for tools for cleaning pipe threads, or pipes and fittings, prior to connecting the various parts. Toelke, in U.S. Pat. No. 4,372,003, describes a powered pipe thread cleaner with a housing having driven brushes. The device includes brushes inside and outside the pipe. In U.S. Pat. No. 4,433,448, True discloses another powered thread cleaner with adjustable arms that have brushes. The system is designed to fit various sized pipes by adjusting the arms.

Roberts, in U.S. Pat. No. 4,530,127, describes a thread cleaning device with a clamp for securing the pipe and radial brushes that are adjustable to fit various sized pipes. In the device shown one set of brushes cleans internal threads and another set of brushes cleans external threads. In U.S. Pat. No. 4,575,892, Ross discloses a device for cleaning male and female electrical connectors using one or more brushes. The brushes are configured for insertion into connector orifices.

Miner, in U.S. Pat. No. 4,600,444, discloses a pipe thread cleaner assembly that includes at least one rotating brush that revolves around the outside of the pipe and at least one brush that rotates inside the pipe.

In U.S. Pat. No. 4,862,549, Criswell et al. disclose a device for cleaning pipes or fittings, including an internal brush for cleaning of fittings and an external brush for cleaning of pipe, prior to soldering or brazing. Both brushes are provided in a single tool so that either tube or fitting can be cleaned without changing or reversing the tool. A drive socket is provided on the brush holder shell to permit manual or motor driven operation. Both brushes are fixed, so cleaning the exterior of a pipe or fitting requires the inside be cleaned, as well.

Guidry et al., in U.S. Pat. No. 5,157,802, describe a pipe thread cleaner having cleaning heads with rotating thread brushes driven by motors on the heads. Separate heads for the box and pin ends have splash shrouds with gaskets to bear on pipe surfaces. In U.S. Pat. No. 5,307,534, Miller discloses a multi-purpose rotary pipe or tubing cleaner specially adapted for cleaning copper pipe and fittings for sweat soldering joints. The device has rotary internal and external brushes and an internal reamer. Note the separate chucks for each brush of FIG. 2 and the separate brushes required in FIGS. 3–6.

U.S. Pat. No. 6,065,173 by White describes a pair of electrical motors each with a shaft and a brush on the shaft. One brush is for the interior and one is for the exterior of pipes or fittings. Carter, in U.S. Pat. No. 6,106,370 discloses a pipe cleaner attachment with a housing having a shuttle guide slidably mounted therein. A pair of brush levers are pivotally mounted in brush guide slots. A reamer is also included in the device.

Thus, there exists an unmet need for a simple device that can quickly yet selectively clean either the inside or the outside of tubing or fittings prior to joining of the components by soldering or brazing.

SUMMARY OF THE INVENTION

The invention is directed to an adjustable fitting and pipe cleaning brush device. The brush device includes a hollow cylindrical member having an interior and exterior surface, an open end and a closed end, with the closed end having an axial aperture there through. An outer wire brush member is circumferentially positioned on the cylindrical member interior surface adjacent to the open end thereof, with the outer brush member having an axial aperture there through. An inner wire brush member is connected at one end to a linear shaft member. The inner brush member fits within the hollow cylindrical member between the outer brush member and the closed end thereof, with the linear shaft member extending through the closed end axial aperture, the linear shaft member axially moveable therein. An engaging means is present for securing the shaft member to the cylindrical member closed end for transferring rotational movement from the shaft member to the hollow cylindrical member. The inner brush member and attached shaft member are axially extendable through the outer brush member aperture to position the inner brush member beyond the cylindrical member open end with the shaft member maintained within the axial aperture of the cylindrical member closed end.

DESCRIPTION OF THE PREFERRED EMBODIMENTS

Nomenclature

Figure 1:
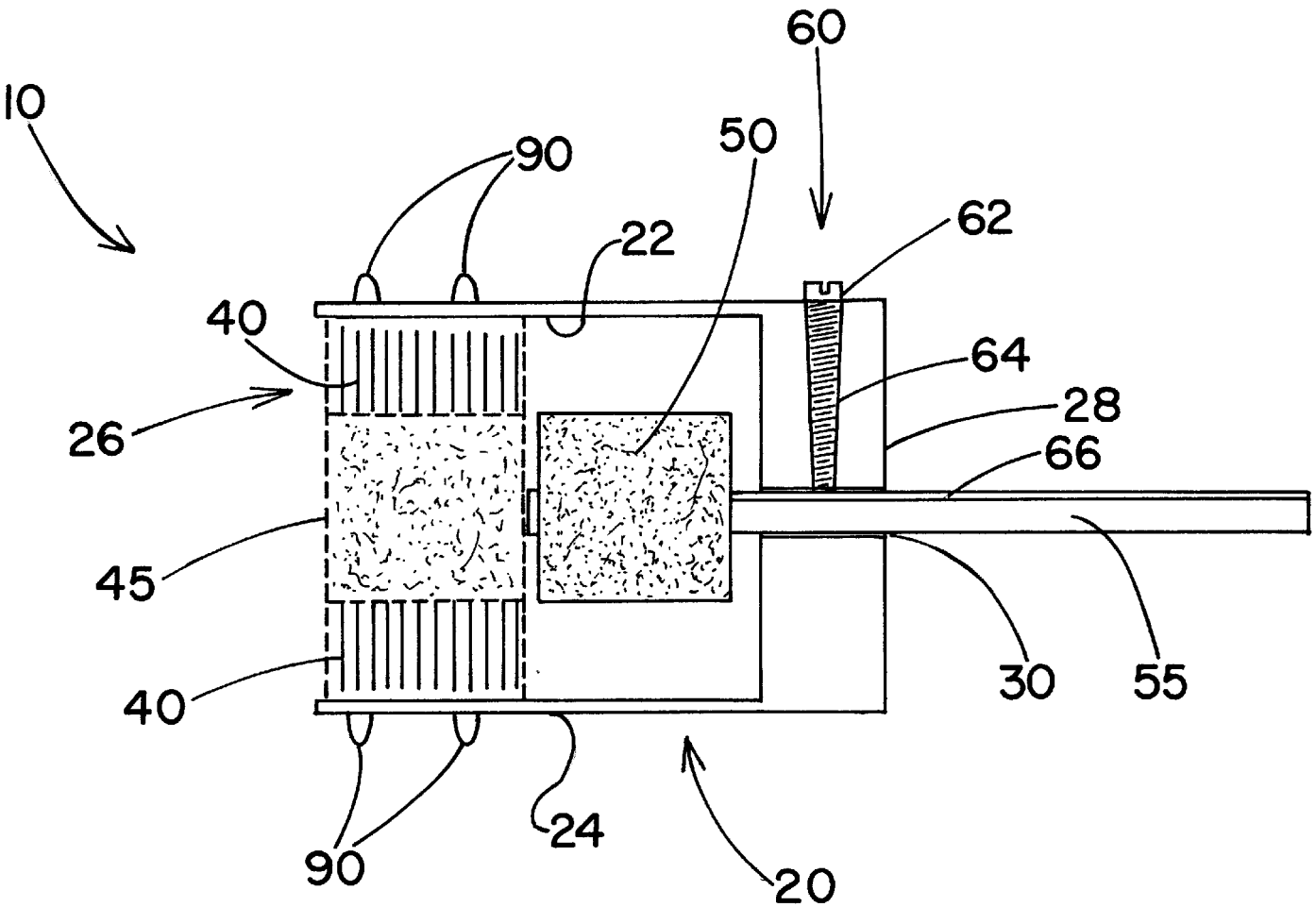
FIG. 1 is a sectional view of one embodiment of the adjustable brush device of the present invention.

10 Adjustable Brush Device
20 Hollow Cylindrical Member
22 Interior Surface of Cylindrical Member
24 Exterior Surface of Cylindrical Member
26 Open End of Cylindrical Member
28 Closed End of Cylindrical Member
30 Axial Aperture in Closed End
40 Outer Brush Member
45 Axial Aperture in Outer Brush
50 Inner Brush Member
55 Linear Shaft Member
60 Shaft Engaging Means
62 Set Screw Member
64 Threaded Aperture
66 Flat Surface of Shaft Member
70 Splined Axial Aperture in Closed End
72 Splined Linear Shaft Member
80 Stop Means
82 Biasing Means
84 Channel of Shaft Member
86 Spring Clop Member
90 Knurled Ridge Member
120 Hollow Cylindrical Member
122 Interior Surface of Cylindrical Member
124 Exterior Surface of Cylindrical Member
126 Open End of Cylindrical Member
128 Closed End of Cylindrical Member
130 Axial Aperture in Closed End
150 First Cylindrical Section
155 Second Cylindrical Section
160 Cylindrical Closed End Section Construction Referring to FIGS. 1–4, one embodiment of the adjustable fitting and pipe cleaning brush device 10 is shown. The cleaning brush device 10 includes a hollow cylindrical member 20 having an interior surface 22 and exterior surface 24, with an open end 26 and a closed end 28 having an axial aperture 30 there through. The hollow cylindrical member 20 may be fabricated from metal or polymeric resin such as polycarbonate.

An outer wire brush member 40 is circumferentially positioned on the cylindrical member interior surface 22 adjacent to the open end 26 thereof, with the outer brush member 40 having an axial aperture 45 there through. An inner wire brush member 50 is connected at one end to a linear shaft member 55. The inner brush member 50 fits within the hollow cylindrical member 20 between the outer brush member 40 and the closed end 28 thereof, with the linear shaft member 55 extending through the closed end axial aperture 30, as seen in FIG. 1. The linear shaft member 55 is axially moveable within the closed end axial aperture 30. An engaging means 60 is present for securing the shaft member 55 to the cylindrical member closed end 28 for transferring rotational movement from the shaft member 55 to the hollow cylindrical member 20.

Figure 2:
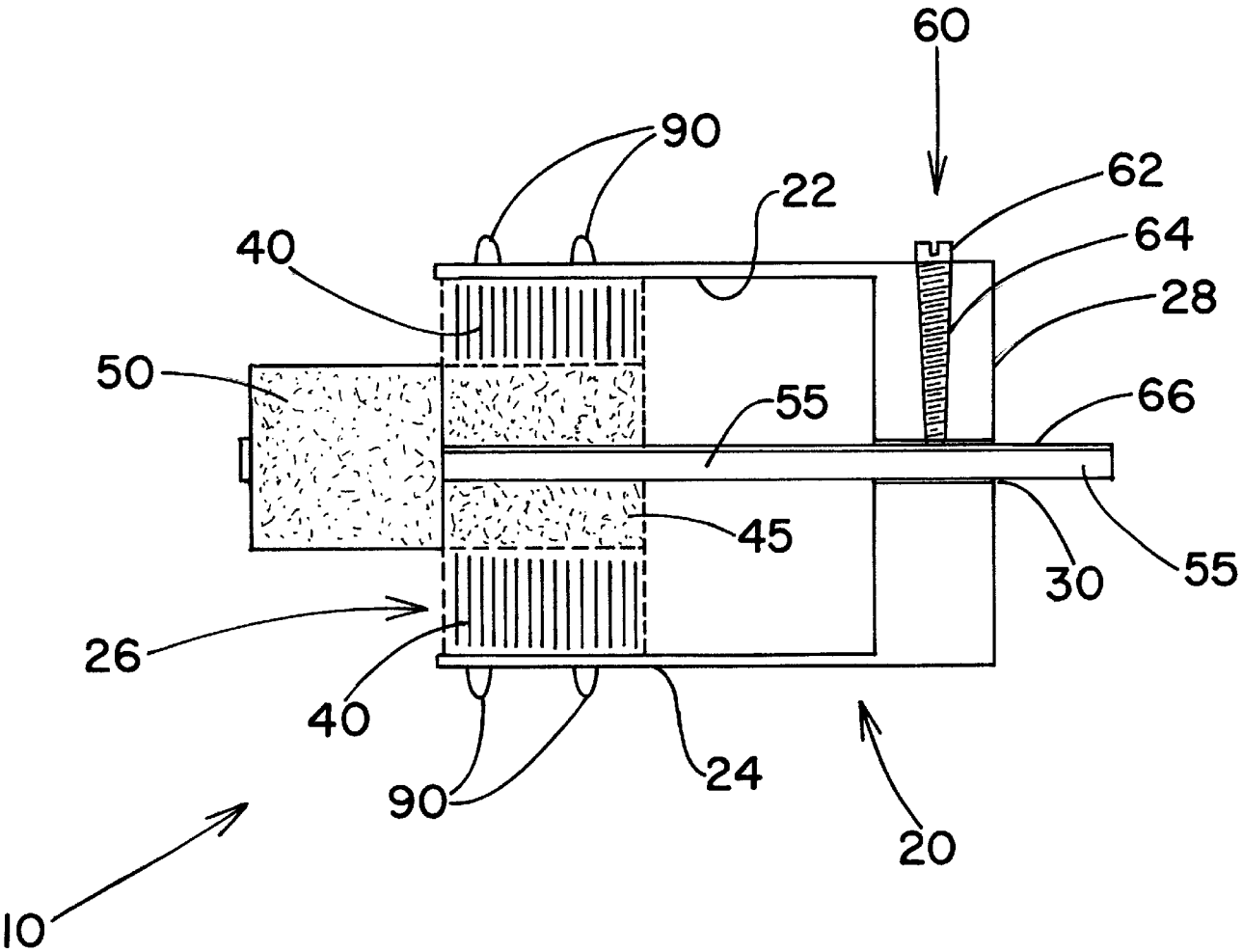
FIG. 2 is a sectional view of the adjustable brush device of the present invention with the inner brush member extended.
Figure 3:
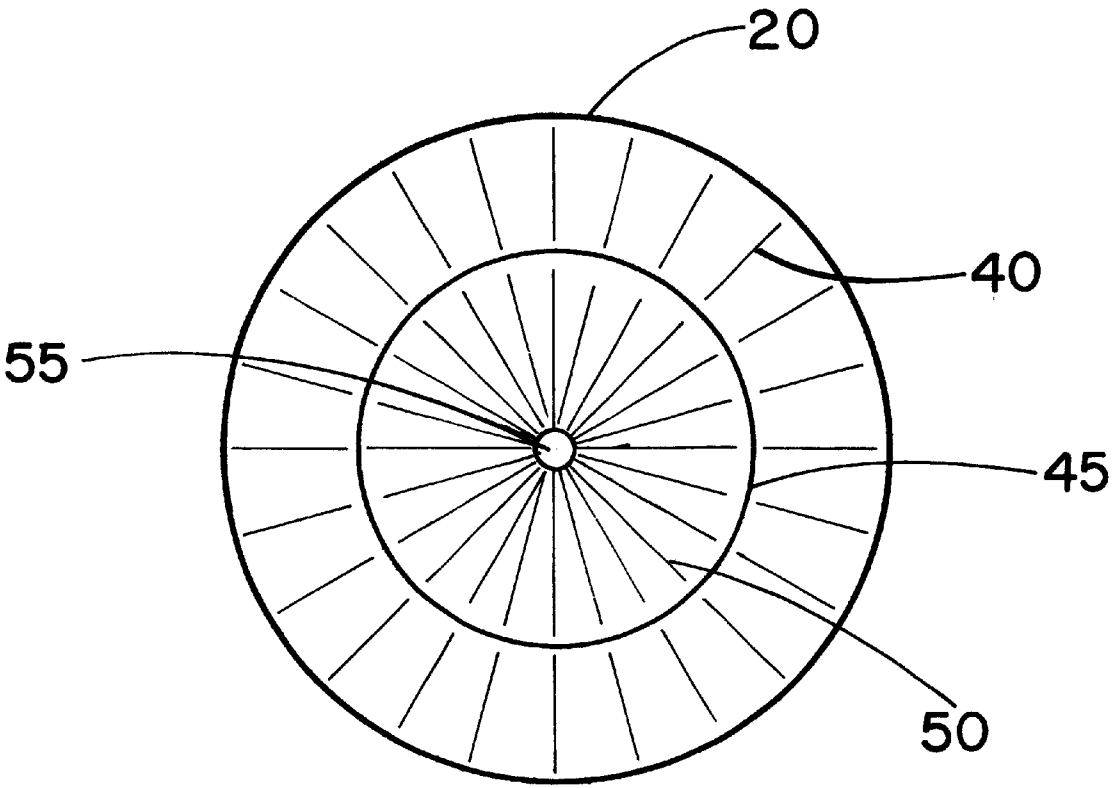
FIG. 3 is an end view of on embodiment of the adjustable brush device of the present invention.
Figure 4:
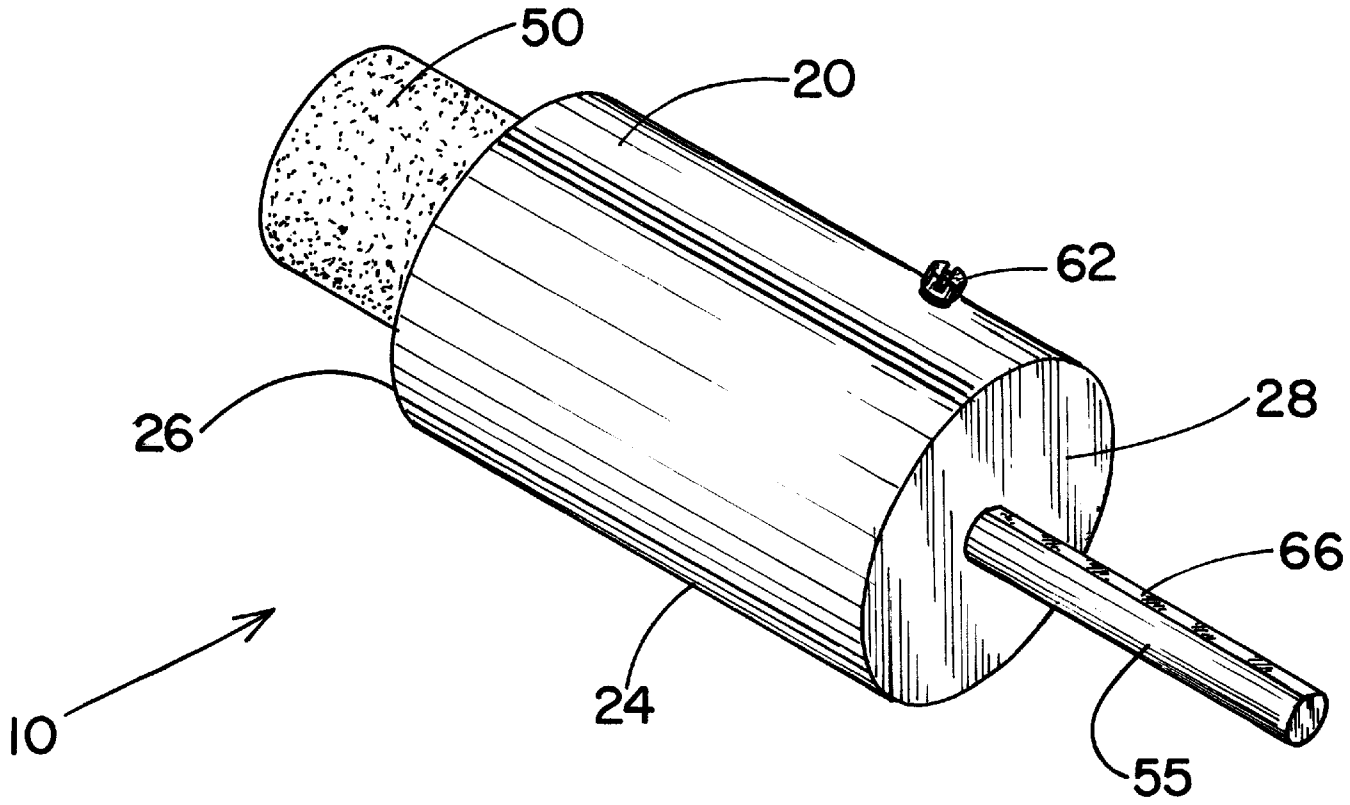
FIG. 4 is a perspective view of one embodiment of the adjustable brush device of the present invention.

The inner brush member 50 and attached shaft member 55 are axially extendable through the outer brush member aperture 45 to position the inner brush member 50 beyond the cylindrical member open end 26 with the shaft member 55 maintained within the axial aperture 30 of the cylindrical member closed end 28, as shown in FIG. 2. The inner wire brush member 40 and the outer wire brush member 50 are fabricated from high carbon steel or stainless steel and are well known in the industry for use in cleaning copper fittings and tubing. The inner brush member 40 can be fabricated as an insert that is bonded to the interior surface of the hollow cylindrical member 20, or the wire bristles of the inner brush member 40 can be integrally molded into the hollow cylindrical member 20 when it is fabricated from a polymeric resin such as polycarbonate. The linear shaft member 55 is fabricated from tool steel or stainless steel for strength and durability.

The shaft engaging means 60 shown in this embodiment of the present invention comprises a set screw member 62 in a threaded aperture 64 that extends between the hollow cylindrical member exterior surface 24 and the axial aperture 30 in the hollow cylindrical member closed end 28. There is provided at least one flat surface 66 on the shaft member 55 for contacting the set screw member 62 as the screw member moves into the axial aperture 30. The set screw member 62 provides a simple method for adjusting the linear shaft member 55 and attached inner brush member 50 relative to the outer brush member 40 of the hollow cylindrical member 20.

In a further embodiment of the invention, one or more knurled ridge members 90 encircle the hollow cylindrical member 20 near the open end 26 thereof The ridge members 90 provide a gripping surface for a user's hand when working with the adjustable brush device 10.

The adjustable fitting and pipe cleaning brush device 10 is used to selectively clean either the interior of a copper fitting or the exterior of a copper pipe prior to forming a joint by soldering or braising the two pieces. The adjustable brush device 10 is sized for use with a particular diameter of fittings and pipe, ranging from as small as one quarter inch diameter to as large as several inches in diameter. The adjustable brush device 10 is fitted to a rotatory power source such as an electric drill by securing the linear shaft member 55 within the chuck of the drill. With the inner brush member 50 positioned within the hollow cylindrical member 20, the copper tubing is inserted into the brush device open end 26 and the drill is operated to rotate the brush device 10 to cause the outer brush member 40 to clean the outer surface of the tubing. To clean the inner surface of a fitting, the shaft engaging means 60, in this embodiment the set screw member 62, is loosened and the inner brush member 50 and attached shaft 55 are moved through the outer brush member axial aperture 45 to position the inner brush member 50 beyond the cylindrical member open end 26, The set screw member 62 is tightened on the shaft member 55, the inner brush member 50 is inserted within a fitting, and the drill is operated to rotate the brush device 10 to cause the inner brush member 50 to clean the fitting inner surface.

Thus, a user can clean either a fitting inner surface or a tubing outer surface with the same brush device 10 without removing the device 10 from the drill chuck. Additionally, should one or the other brush members 40, 50 become damaged or worn, only the part of the adjustable brush device 10 that is worn or damaged needs to be replaced. The useful life of the adjustable brush device 10 is maximized, in that portions of the fitting and tubing that do not require cleaning when making a solder or braised joint are not cleaned, as is the case with some other devices.

Another embodiment of the adjustable brush device of the present invention is shown in FIGS. 5–11. The cleaning brush device 10 includes a hollow cylindrical member 120 having an interior surface 122 and exterior surface 124, with an open end 126 and a closed end 128 having an axial aperture 130 there through. The hollow cylindrical member 120 includes a first cylindrical section 150 of selected diameter which has the open end 126, a second cylindrical section 155 of diameter less than the first cylindrical section 150, with the second cylindrical section 155 joined to the first cylindrical section 150 opposite the open end 126 thereof, and a closed end third cylindrical section 160 of diameter less than the second cylindrical section 155, the closed end third cylindrical section 160 joined to the second cylindrical section 155 opposite the first cylindrical section 150, the third cylindrical section having the axial aperture 130 there through. The hollow cylindrical member 120 may be fabricated from metal or polymeric resin such as polycarbonate.

Figure 5:
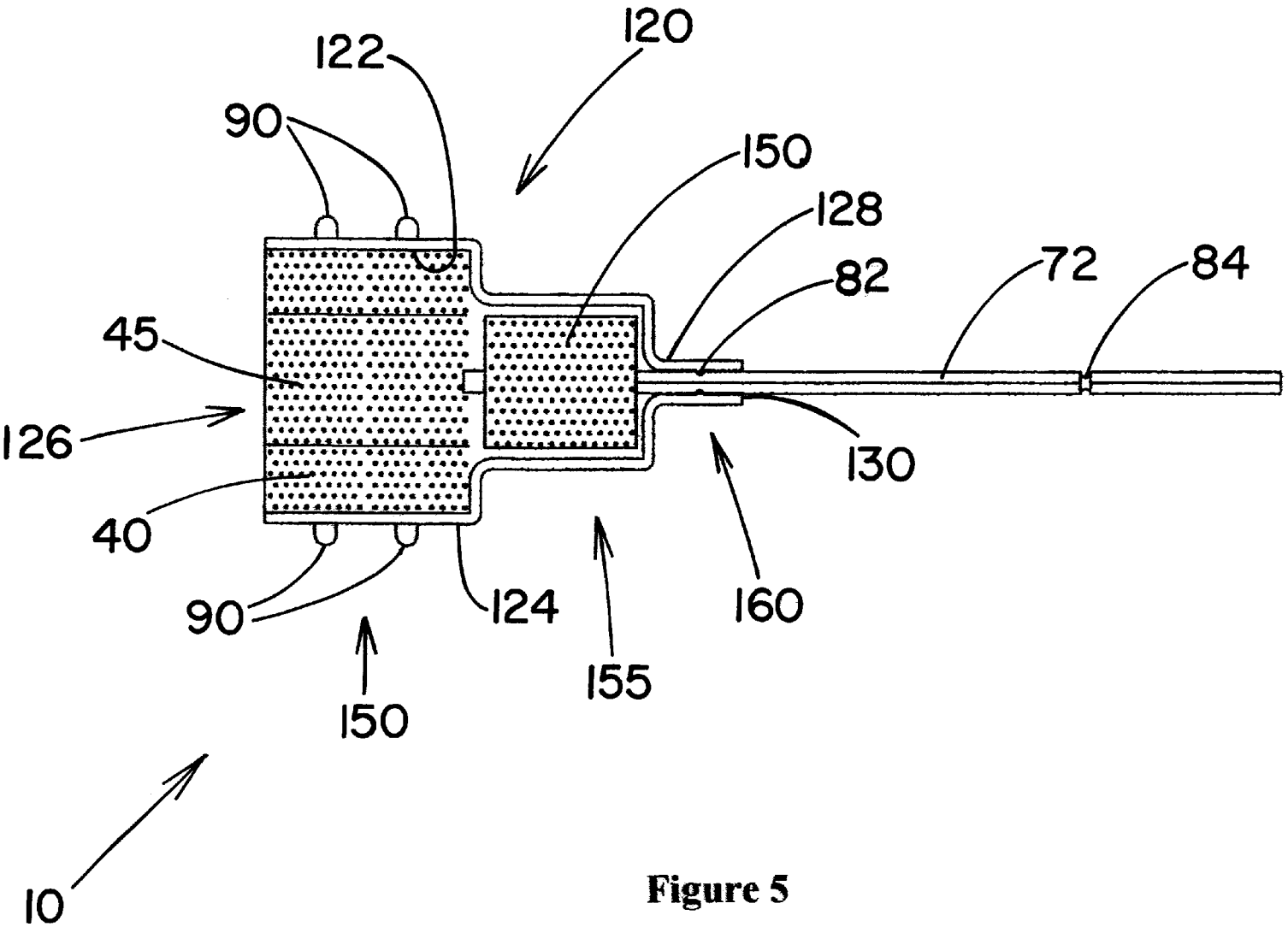
FIG. 5 is a sectional view of another embodiment of the adjustable brush device of the present invention.

An outer wire brush member 40 is circumferentially positioned on the first cylindrical section 150 interior surface 122 adjacent to the open end 126 thereof, with the outer brush member 40 having an axial aperture 45 there through. An inner wire brush member 50 is connected at one end to a linear shaft member 55. The inner brush member 50 fits within the hollow cylindrical member second cylindrical section 155 between the outer brush member 40 and the closed end 128 thereof, with the linear shaft member 55 extending through the closed end axial aperture 130, as seen in FIG. 5. The linear shaft member 55 is axially moveable within the closed end axial aperture 130. An engaging means 60 is present for securing the shaft member 55 to the cylindrical member closed end 128 for transferring rotational movement from the shaft member 55 to the hollow cylindrical member 120.

Figure 6:
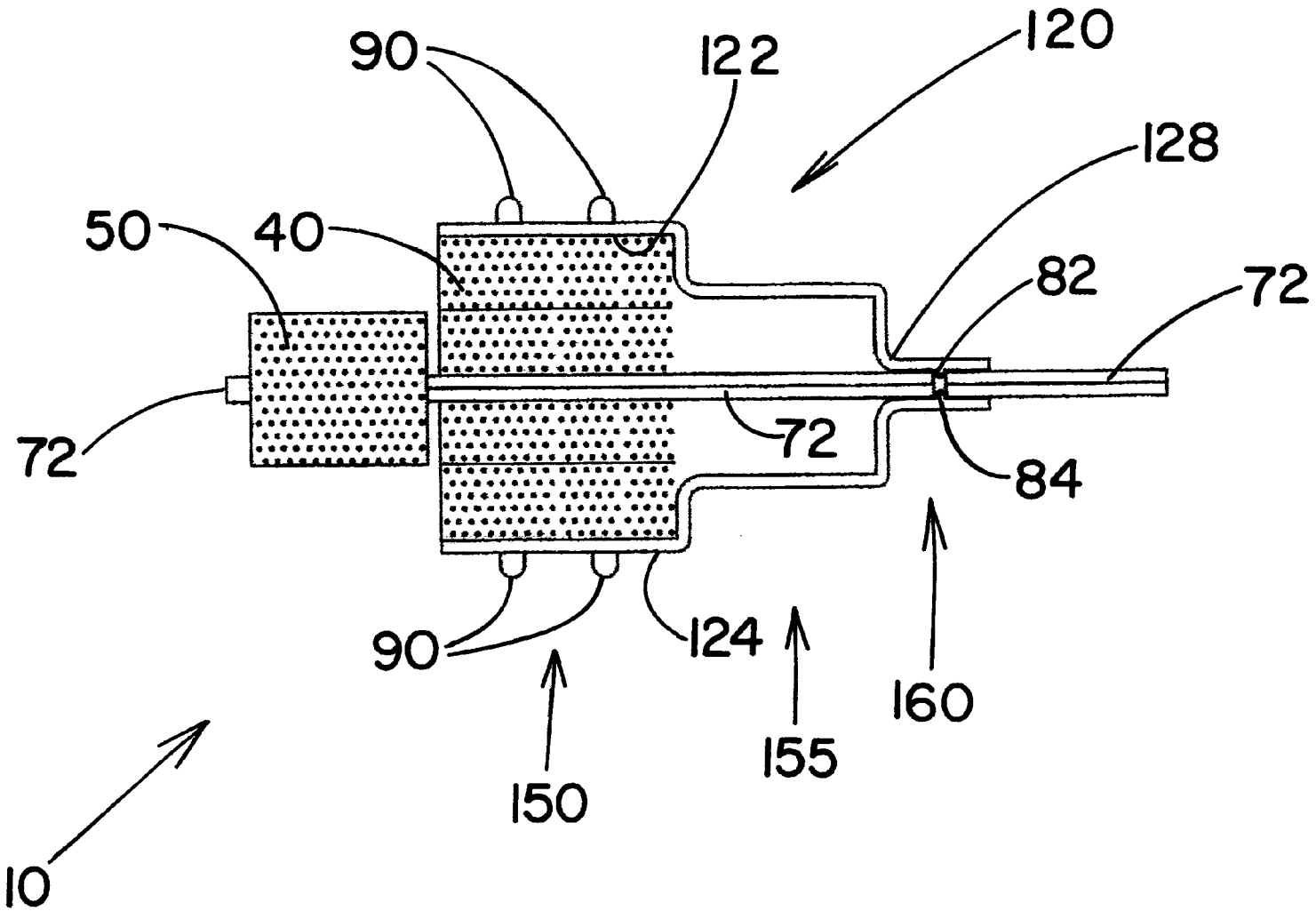
FIG. 6 is a sectional view of another embodiment of the adjustable brush device of the present invention with the inner brush member extended.
Figure 7:
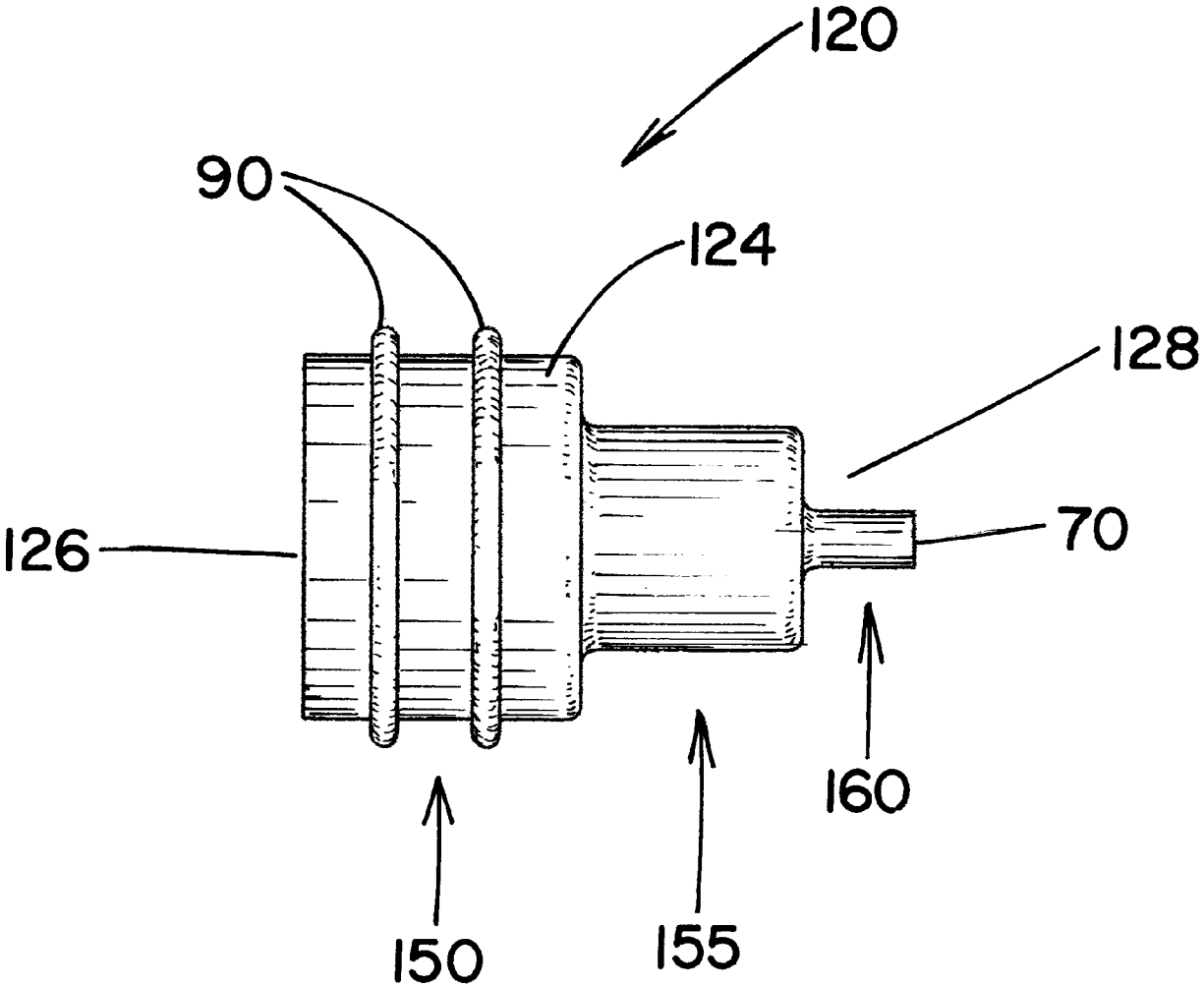
FIG. 7 is a sectional view of an embodiment of the hollow cylindrical member of the adjustable brush device of the present invention.

The inner brush member 50 and attached shaft member 55 are axially extendable through the outer brush member aperture 45 to position the inner brush member 50 beyond the cylindrical member open end 126 with the shaft member 55 maintained within the axial aperture 130 of the cylindrical member closed end 128, as shown in FIG. 6. The inner wire brush member 40 and the outer wire brush member 50 are fabricated from high carbon steel or stainless steel and are well known in the industry for use in cleaning copper fittings and tubing. The inner brush member 40 can be fabricated as an insert that is bonded to the interior surface of the first cylindrical section 150 of the hollow cylindrical member 120, or the wire bristles of the inner brush member 40 can be integrally molded into the first cylindrical section 150 of the hollow cylindrical member 120 when it is fabricated from a polymeric resin such as polycarbonate. The linear shaft member 55 is fabricated from tool steel or stainless steel for strength and durability.

Figure 8:
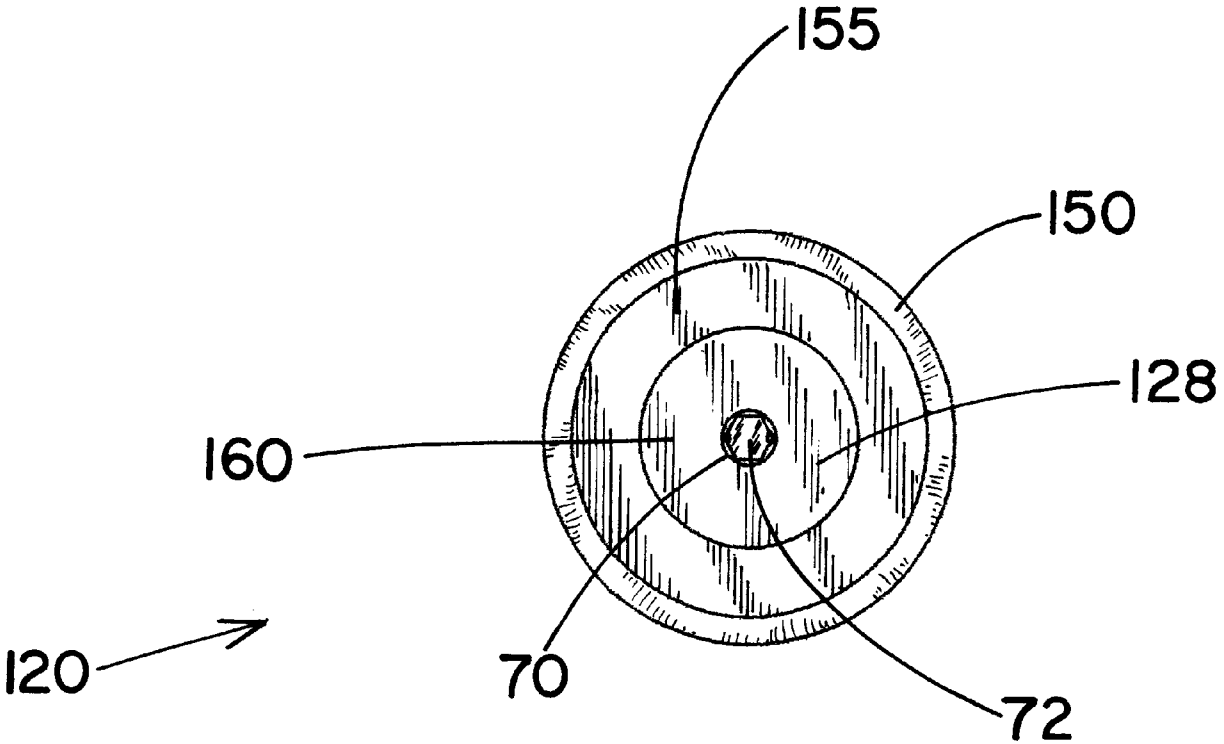
FIG. 8 is an end view of an embodiment of the hollow cylindrical member of the adjustable brush device of the present invention.
Figure 10:
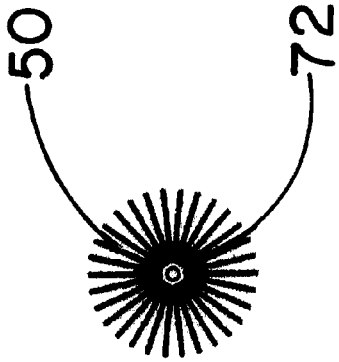
FIG. 10 is an end view of the inner brush member of the adjustable brush device of the present invention.
Figure 9:
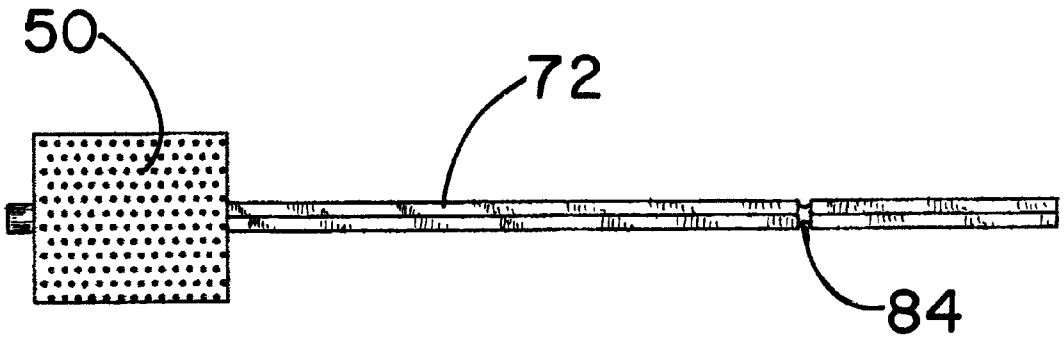
FIG. 9 is a sectional view of one embodiment of the inner brush member and attached linear shaft member of the adjustable brush device of the present invention.
Figure 11:
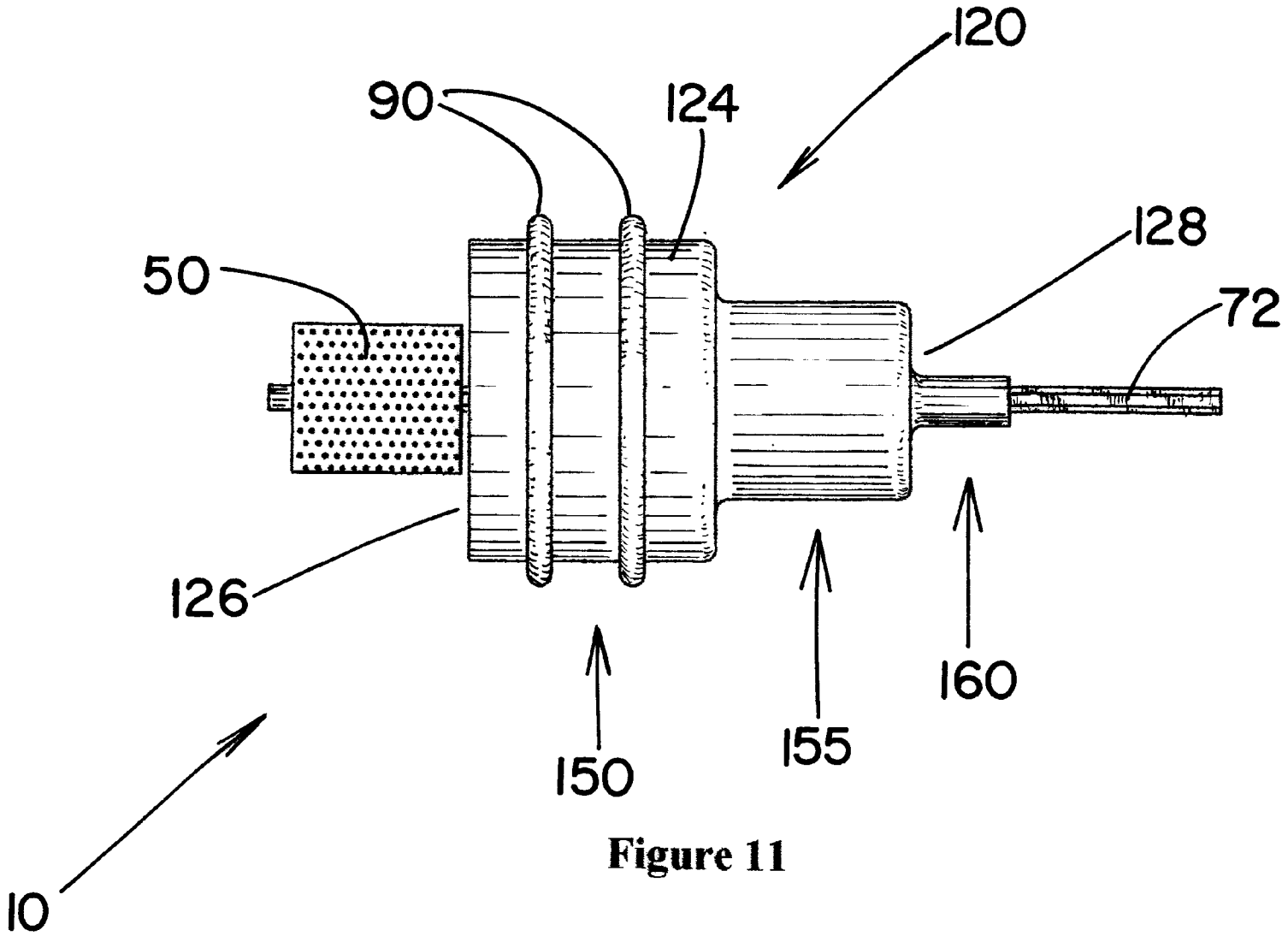
FIG. 11 is a perspective view of another embodiment of the adjustable brush device of the present invention.

The shaft engaging means 60 shown in this embodiment of the present invention comprises a splined axial aperture 70 in the hollow cylindrical member closed end 130 and a splined shaft member 72. The splined shaft member 72 has a polyhedral cross section, such as a hexagon as shown in FIG. 9, and the splined axial aperture 70 has a matching polyhedral cross section, such as a hexagon again as shown in FIG. 8. Thus, rotation of the splined shaft member 72 imparts rotary motion to the hollow cylindrical member 120. The splined relationship of these two elements provides a simple method for adjusting the linear shaft member 55 and attached inner brush member 50 relative to the outer brush member 40 of the hollow cylindrical member 120.

Further, the splined shaft member 72 and closed end axial aperture 130 include a stop means 80 for positioning the inner brush member 50 beyond the cylindrical member open end 126. The stop means 80 includes a biasing means 82 positioned within the closed end axial aperture 130 for engaging a circumferential channel 84 in the splined shaft member 72. Thus, the biasing means 82 holds the splined shaft member 72 and maintains the inner brush member 50 within the second cylindrical section 155 of the hollow cylindrical member 120 while the outer brush member 40 is used to clean the end of a pipe. The inner brush member 50 can then be positioned exterior the hollow cylindrical member open end 126 by sliding the splined shaft member 72 within the splined axial opening 130 until the circumferential channel 84 reaches the biasing means 82 and is engaged thereby. The biasing means 82 includes a spring clip 86 or a spring biased metal ball, both well known devices for this purpose.

In a further embodiment of the invention, one or more knurled ridge members 90 encircle the hollow cylindrical member 120 near the open end 126 thereof The ridge members 90 provide a gripping surface for a user's hand when working with the adjustable brush device 10.

The adjustable fitting and pipe cleaning brush device 10 is used to selectively clean either the interior of a copper fitting or the exterior of a copper pipe prior to forming a joint by soldering or braising the two pieces. The adjustable brush device 10 is sized for use with a particular diameter of fittings and pipe, ranging from as small as one quarter inch diameter to as large as several inches in diameter. The adjustable brush device 10 is fitted to a rotatory power source such as an electric drill by securing the linear shaft member 55 within the chuck of the drill. With the inner brush member 50 positioned within the hollow cylindrical member 120, the copper tubing is inserted into the brush device open end 126 and the drill is operated to rotate the brush device 10 to cause the outer brush member 40 to clean the outer surface of the tubing. To clean the inner surface of a fitting, the splined shaft member 72 is moved within the splined axial aperture 70 to move the inner brush member 50 through the outer brush member axial aperture 45 and position the inner brush member 50 beyond the cylindrical member open end 126. The biasing means 82 snaps into the channel 84 on the shaft member 55, after which the inner brush member 50 is inserted within a fitting, and the drill is operated to rotate the brush device 10 to cause the inner brush member 50 to clean the fitting inner surface.

Thus, a user can clean either a fitting inner surface or a tubing outer surface with the same brush device 10 without removing the device 10 from the drill chuck. Additionally, should one or the other brush members 40, 50 become damaged or worn, only the part of the adjustable brush device 10 that is worn or damaged needs to be replaced. The useful life of the adjustable brush device 10 is maximized, in that portions of the fitting and tubing that do not require cleaning when making a solder or braised joint are not cleaned, as is the case with some other devices.

While the invention has been particularly shown and described with reference to preferred embodiments thereof, it will be understood by those skilled in the art that various changes in form and details may be made therein without departing from the spirit and scope of the invention.

I claim:

1. An adjustable fitting and pipe cleaning brush device comprising;

a hollow cylindrical member having an interior and exterior surface, an open end and a closed end, the closed end having an axial aperture there through;

an outer wire brush member circumferentially positioned on the cylindrical member interior surface adjacent the open end thereof, the outer brush member having an axial aperture there through;

an inner wire brush member connected at one end to a linear shaft member, the inner brush member fitting within the hollow cylindrical member between the outer brush member and the closed end thereof, with the linear shaft member extending through the closed end axial aperture and axially moveable therein; and engaging means for securing the shaft member to the cylindrical member closed end, including a splined axial aperture in the hollow cylindrical member closed end and a splined shaft member for transferring rotational movement from the shaft member to the hollow cylindrical member;

the inner brush member and attached shaft member axially extendable through the outer brush member aperture to position the inner brush member beyond the cylindrical member open end with the splined shaft member maintained within the splined axial aperture of the cylindrical member closed end.

2. The adjustable fitting and pipe cleaning brush device according to claim 1 wherein the outer brush member axial aperture is cylindrical.

3. The adjustable fitting and pipe cleaning brush device according to claim 1 wherein the inner brush member is cylindrical.

4. The adjustable fitting and pipe cleaning brush device according to claim 1 wherein the engaging means for securing the shaft member to the cylindrical member closed end for transferring rotational movement from the shaft member to the hollow cylindrical member includes a set screw member in a threaded aperture between the hollow cylindrical member exterior surface and the axial aperture in the hollow cylindrical member closed end and at least one flat surface on the shaft member for contacting the set screw member.

5. The adjustable fitting and pipe cleaning brush device according to claim 1 further including a stop means for positioning the inner brush member beyond the cylindrical member open end.

6. The adjustable fitting and pipe cleaning brush device according to claim 5 wherein the stop means includes a biasing means positioned within the closed end axial aperture for engaging a circumferential channel in the shaft member.

7. The adjustable fitting and pipe cleaning brush device according to claim 1 further including a knurled ridge around the hollow cylindrical member on the exterior surface thereof.

8. The adjustable fitting and pipe cleaning brush device according to claim 1 wherein the hollow cylindrical member is fabricated from a synthetic polymeric resin.

9. The adjustable fitting and pipe cleaning brush device according to claim 1 wherein the hollow cylindrical member is fabricated from polycarbonate resin.

10. The adjustable fitting and pipe cleaning brush device according to claim 1 wherein the hollow cylindrical member includes a first cylindrical section of selected diameter and having an open end, a second cylindrical section of diameter less than the first cylindrical section, the second cylindrical section joined to the first cylindrical section opposite the open end thereof, and a closed end third cylindrical section of diameter less than the second cylindrical section, the closed end third cylindrical section joined to the second cylindrical section opposite the first cylindrical section, the third cylindrical section having said axial aperture there through.

11. An adjustable fitting and pipe cleaning brush device comprising;

a hollow cylindrical member having an interior and exterior surface, the hollow cylindrical member including a first cylindrical section of selected diameter and having an open end, a second cylindrical section of diameter less than the first cylindrical section, the second cylindrical section joined to the first cylindrical section opposite the open end thereof, and a closed end third cylindrical section of diameter less than the second cylindrical section, the closed end third cylindrical section joined to the second cylindrical section opposite the first cylindrical section, the third cylindrical section having an axial aperture there through;

an outer wire brush member circumferentially positioned on the cylindrical member interior surface of the first cylindrical section and adjacent the open end thereof, the outer brush member having an axial aperture there through;

an inner wire brush member connected at one end to a linear shaft member, the inner brush member fitting within the second cylindrical section between the outer brush member and the third cylindrical section closed end thereof, with the linear shaft member extending through the third cylindrical section closed end axial aperture and axially moveable therein; and engaging means for securing the shaft member to the cylindrical member closed end for transferring rotational movement from the shaft member to the hollow cylindrical member;

the inner brush member and attached shaft member axially extendable through the outer brush member aperture to position the inner brush member beyond the cylindrical member open end with the shaft member maintained within the axial aperture of the cylindrical member closed end.

12. The adjustable fitting and pipe cleaning brush device according to claim 11 wherein the outer brush member axial aperture and the inner brush member are cylindrical.

13. The adjustable fitting and pipe cleaning brush device according to claim 11 wherein the engaging means for securing the shaft member to the cylindrical member closed end for transferring rotational movement from the shaft member to the hollow cylindrical member includes a splined axial aperture in the hollow cylindrical member closed end and a splined shaft member.

14. The adjustable fitting and pipe cleaning brush device according to claim 11 wherein the engaging means for securing the shaft member to the cylindrical member closed end for transferring rotational movement from the shaft member to the hollow cylindrical member includes a set screw member in a threaded aperture between the hollow cylindrical member exterior surface and the axial aperture in the hollow cylindrical member closed end and at least one flat surface on the shaft member for contacting the set screw member.

15. The adjustable fitting and pipe cleaning brush device according to claim 11 further including a stop means for position the inner brush member beyond the cylindrical member open end.

16. The adjustable fitting and pipe cleaning brush device according to claim 15 wherein the stop means includes a biasing means positioned within the closed end axial aperture for engaging a circumferential channel in the shaft member.

17. The adjustable fitting and pipe cleaning brush device according to claim 16 further including a knurled ridge around the hollow cylindrical member on the exterior surface thereof.

18. The adjustable fitting and pipe cleaning brush device according to claim 11 wherein the hollow cylindrical member is fabricated from a synthetic polycarbonate resin.

19. An adjustable fitting and pipe cleaning brush device comprising;

a hollow cylindrical member having an interior and exterior surface, the hollow cylindrical member including a first cylindrical section of selected diameter and having an open end, a second cylindrical section of diameter less than the first cylindrical section, the second cylindrical section joined to the first cylindrical section opposite the open end thereof, and a closed end third cylindrical section of diameter less than the second cylindrical section, the closed end third cylindrical section joined to the second cylindrical section opposite the first cylindrical section, the third cylindrical section having an axial aperture there through;

an outer wire brush member circumferentially positioned on the cylindrical member interior surface of the first cylindrical section and adjacent the open end thereof, the outer brush member having an axial cylindrical aperture there through;

an inner cylindrical wire brush member connected at one end to a linear shaft member, the inner brush member fitting within the second cylindrical section between the outer brush member and the third cylindrical section closed end thereof, with the linear shaft member extending through the third cylindrical section closed end axial aperture and axially moveable therein; and engaging means for securing the shaft member to the cylindrical member closed end for transferring rotational movement from the shaft member to the hollow cylindrical member, the engaging means including a splined axial aperture in the hollow cylindrical member closed end and a splined shaft member position therein;

the inner brush member and attached shaft member axially extendable through the outer brush member aperture to position the inner brush member beyond the cylindrical member open end with the shaft member maintained within the axial aperture of the cylindrical member closed end; and stop means for position the inner brush member beyond the cylindrical member open end, the stop means including a biasing means positioned within the closed end axial aperture for engaging a circumferential channel in the shaft member.

* * * * *